US006073724A

United States Patent [19]

Wolner et al.

[11] Patent Number: 6,073,724

[45] Date of Patent: Jun. 13, 2000

[54] CONNECTOR FOR A PERSONAL SAFETY DEVICE

[75] Inventors: James T. Wolner, Red Wing; Scott C. Casebolt, St. Paul Park, both of Minn.

[73] Assignee: D B Industries, Inc., Red Wing, Minn.

[21] Appl. No.: 09/177,403

[22] Filed: Oct. 23, 1998

[51] Int. Cl.[7] ..... A47L 3/04

[52] U.S. Cl. ..... 182/3; 182/36

[58] Field of Search ..... 182/3, 36; 24/132 R, 24/133, 115 N, 134 R, 136 R, 136; 248/229.15, 229.25, 231.71, 231.81; 242/399.1, 399.2, 405.3

[56] References Cited

U.S. PATENT DOCUMENTS 4,140,205 2/1979 Matson ..... 182/3
5,156,233 10/1992 Olsen et al. ..... 182/3

*Primary Examiner*—Daniel P. Stodola
*Assistant Examiner*—Hugh B. Thompson
*Attorney, Agent, or Firm*—Mau & Krull, P.A.

[57] ABSTRACT

A connector and a personal safety device are secured in series between a person and a support structure. The connector includes a bolt and another structural member which cooperate to form a closed loop. The bolt extends through opposite ends of the other structural member and at least one flange on the personal safety device. A radially extending flange is rigidly secured to an intermediate portion of the bolt and cooperates with an end of the bolt to capture an end of the other structural member therebetween.

17 Claims, 3 Drawing Sheets

CONNECTOR FOR A PERSONAL SAFETY DEVICE

FIELD OF THE INVENTION

The present invention relates to methods and apparatus for interconnecting a personal safety device in series between a person and a support structure.

BACKGROUND OF THE INVENTION

Various occupations place people in precarious positions at relatively dangerous heights, thereby creating a need for fall-arresting safety apparatus. Such apparatus require a reliable safety line and reliable connections to the support structure and the person working in proximity to the support structure.

Typically, one or more deceleration devices is connected in series with the safety line. For example, U.S. Pat. No. 5,351,906 to Feathers discloses a safety anchorage device which controls pay-out of a safety line. This prior art anchorage device is selectively connected to a support structure, and the safety line is selectively connected to a person (via a body harness, for example). In the event of a fall, the safety line and the other parts of the anchorage device cooperate to safely bring the person to rest.

Another exemplary safety device is disclosed in U.S. Pat. No. 4,877,110 to Wolner. This prior art safety device similarly controls pay-out of a safety line during normal work activity and/or in the event of a fall. In this patent, however, the device is shown anchored to the body harness, and the safety line is shown connected to the support structure.

An object of the present invention is to provide an improved connector for use on and/or together with safety devices like those discussed above.

SUMMARY OF THE INVENTION

The present invention provides methods and apparatus which facilitate connection of a personal safety device in series between a person and a support structure. On a preferred embodiment of the present invention, the distal end of a bolt is inserted though one end of a U-shaped member and through spaced apart tabs on a safety device. The distal end of the bolt is then selectively threaded through an opposite end of the U-shaped member. A stop is rigidly secured to an intermediate portion of the bolt to retain one of the tabs between the stop and the end of the U-shaped member nearer the bolt. A spring is disposed between the stop and the head of the bolt to bias the bolt toward the other tab (and the threaded end of the U-shaped member). The resulting connector is convenient to use and reliable in use, and cooperates with the safety device to provide a novel combination of a safety device with a built-in latching device. Additional features and/or advantages of the present invention may become more apparent from the detailed description which follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
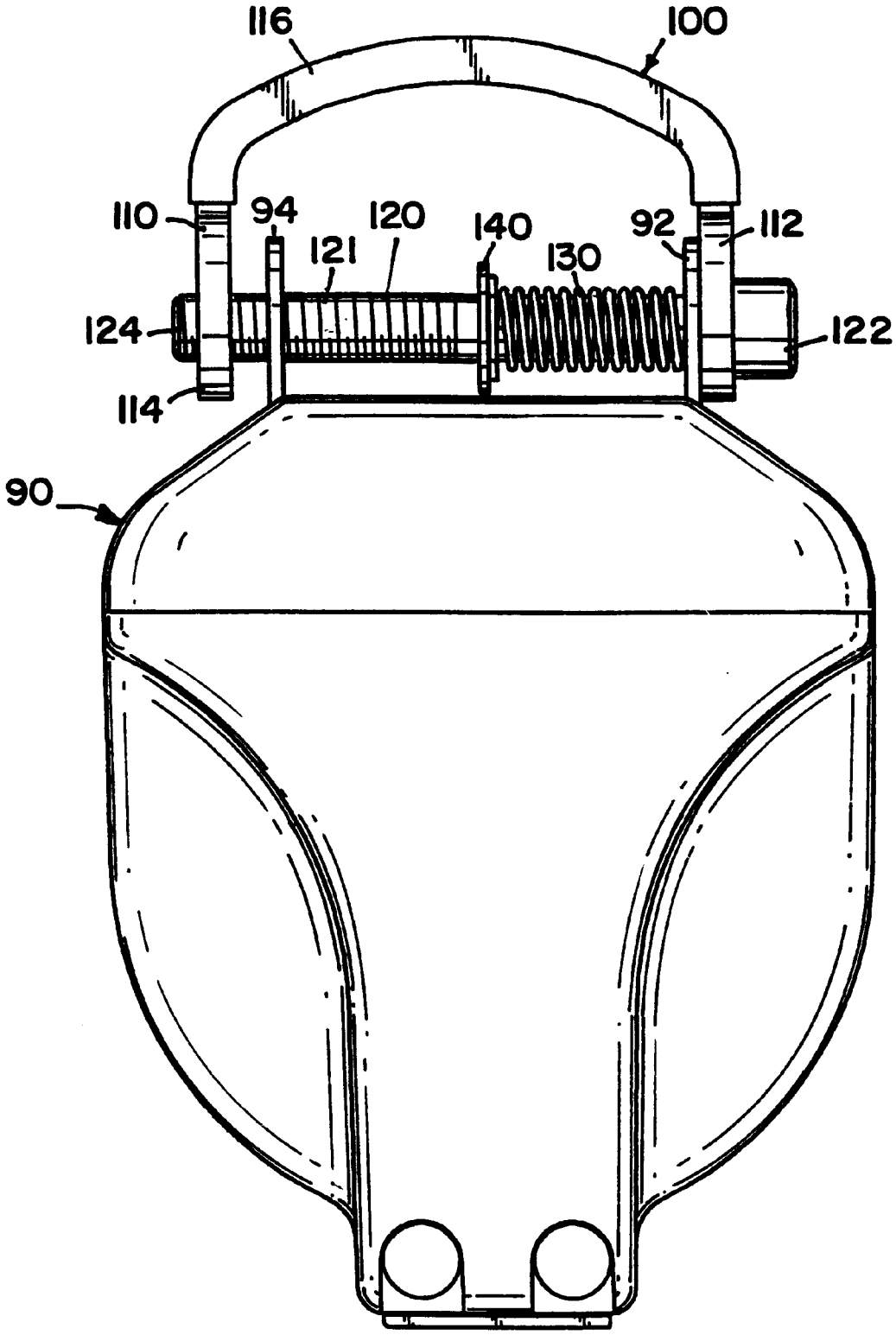
FIG. 1 is a front view of a personal safety apparatus provided with a connector constructed according to the principles of the present invention.
Figure 2:
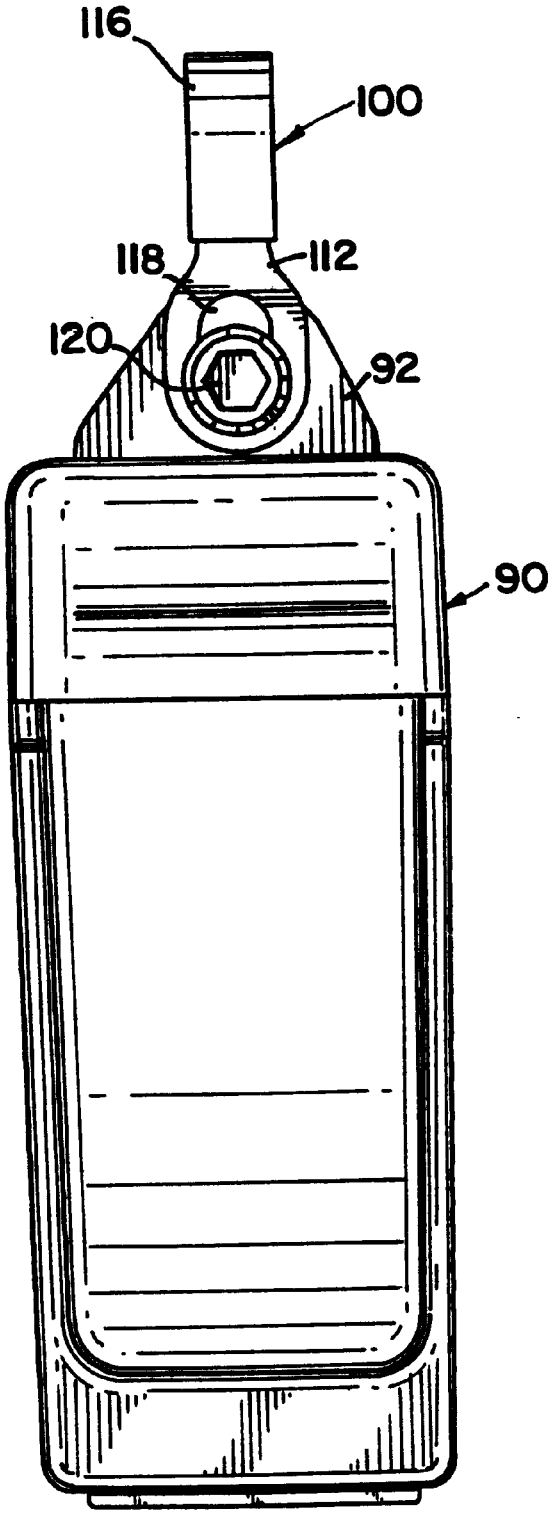
FIG. 2 is a side view of the personal safety apparatus and connector of FIG. 1.
Figure 3:
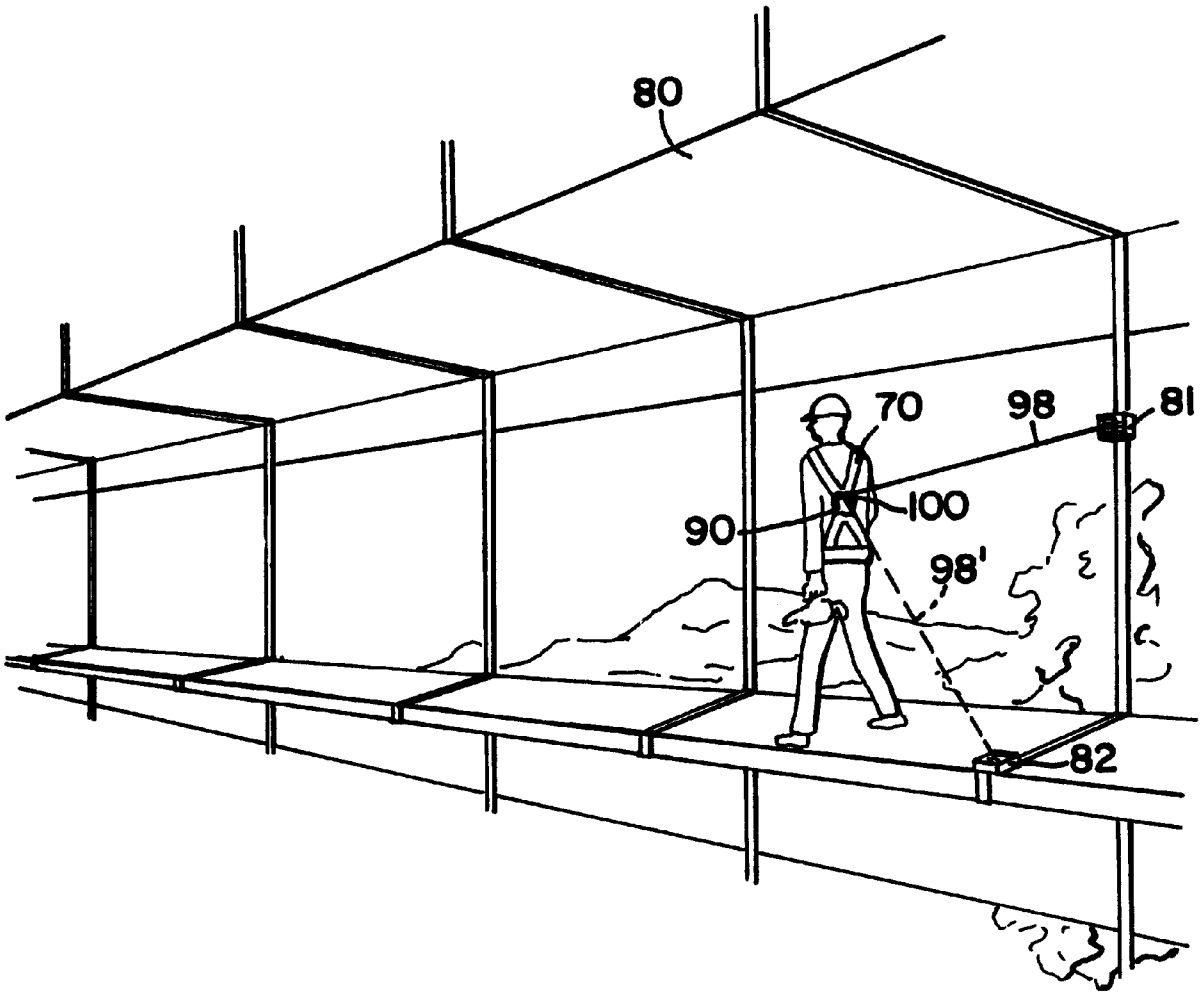
FIG. 3 is a perspective view of the personal safety apparatus and connector of FIG. 1 interconnected in series between a support structure and a body harness.

A preferred embodiment connector constructed according to the principles of the present invention is designated as 100 in FIGS. 1–3. The connector 100 includes a structural member 110 and a bolt 120 which cooperate to releasably connect a personal safety device 90 (with safety line 98) in series between a support structure 80 and a person's harness 70, as shown in FIG. 3. Exemplary prior art safety devices are disclosed in U.S. Pat. No. 5,351,906 to Feathers and U.S. Pat. No. 4,877,110 to Wolner, which are incorporated herein by reference.

The structural member 110 is preferably made of steel and may be described as a U-shaped member having an intermediate base portion, and opposite ends or legs 112 and 114 which extend from opposite ends of the base portion and parallel to one another. The base portion is covered by a protective sleeve 116 which is preferably made of plastic. A slot 118 is provided in the first end 112 of the member 110 (FIG. 2), and a threaded hole is provided in the second end 114 of the member 110.

The bolt 120 is preferably made of steel and has a shaft 121 which extends perpendicular to the ends 112 and 114 of the member 110. A first end 122 of the bolt 120 is provided with a head having a diameter which is greater than the diameter of the shaft 121. A second, opposite end 124 of the bolt 120 is provided with external helical threads which mate with the threaded hole in the second end 114 of the member 110.

The second end 124 of the bolt 120 is inserted through the slot 118, then through a hole in a first flange or tab 92 on the device 90, and then through a helical coil spring 130. A stop 140 is then rigidly secured to an intermediate portion of the shaft 121 on the bolt 120, in such a manner that the spring 130 is compressed between the stop 140 and the flange 92. The stop 140 has a relatively larger diameter than the shaft 121 of the bolt 120 and may be described as a shoulder on the bolt 120. The second end 124 may then be selectively inserted through a hole in a second flange or tab 94 on the device 90, and threaded through the hole in the second end 114 of the member 110.

The threads on the second end 124 of the bolt 120 and inside the hole in the second end 114 of the member 110 provide a means for selectively connecting the second end 124 of the bolt 120 to the second end 114 of the member 110. The spring 130 cooperates with the stop 140 to provide a means for biasing the second end 124 of the bolt 120 to remain connected to the second end 114 of the member 110. The stop 140, the first end 112 of the member 110, and the head of the bolt 120 cooperate to provide a means for securing the connector 100 to the first flange 92. The slot 118 in the first end 112 of the member 110 provides a means for pivoting the connector 100 relative to the first flange 92 when the second end 122 of the bolt is free of the second flange 94.

Those skilled in the art will recognize that alternative arrangements may be used to perform one or more of the aforementioned functions. For example, the first end 112 of the member 110 may be hinged relative to the remainder thereof to facilitate pivoting of the connector 100 relative to the first flange 92. Also, the bias of the spring 130 may operate (in the absence of threads) to facilitate connection of the second end 124 of the bolt 120 to the second end 114 of the member 110. On one alternative embodiment, for example, the second end 124 of the bolt 120 is devoid of threads and has an outside diameter which is less than the inside diameter of the threaded hole. Thus, even when the shaft 121 is not threaded into the threaded hole, the spring 130 biases the second end 124 to remain in the hole. Another option is to use a cotter pin or other latching device to further discourage undesired removal of the bolt end 124 from the member end 114.

Those skilled in the art will also recognize that the connector 100 may be used at various locations in various personal safety systems. For example, FIG. 3 shows the connector 100 attached to the personal safety device 90 and releasably connected to a harness 70 in the same manner as and/or by means of a D-ring, for example. A safety line 98 (or 98') emanates from the device 90 and is releasably connected to a support structure 80. This arrangement is advantageous because it facilitates convenient locking into and out of discrete anchorages (81 and 82, for example) on the support structure. However, the connector 100 may be used in other arrangements according to the needs dictated by a particular situation and/or the preferences of the persons involved.

Another aspect of the present invention is the provision of a built-in connector or latching device on a personal safety device. In other words, a safety device constructed according to the principles of the present invention may be connected directly about a rod or safety line secured to a support structure, thereby eliminating the need for an interconnecting snap hook or other discrete component. In this regard, the connection between the stop 140 and the bolt 120 is intended to be permanent, and thus, the present invention may be seen to provide both the safety device and the connecting means as a unit.

Those skilled in the art will further recognize that the present invention may also be described in terms of a method (with reference to the preferred embodiment 100, for example). In one regard, the present invention may be described in terms of a method of connecting a personal safety device in series between a person and a support structure. A bolt is inserted through a first end of a U-shaped member and through a first flange on the personal safety device. A coil spring is positioned on the bolt and retained in place by rigidly mounting a stop on an intermediate portion of the bolt. A second end of the U-shaped member is disposed about a suitable anchorage and/or inserted through a desired opening (such as a bracket on the support structure or a D-ring on a body harness), and then is aligned with a second flange on the personal safety device. A distal end of the bolt is then inserted through the second flange and threaded into the second end of the U-shaped member.

Although the present invention has been described with reference to a preferred embodiment and a particular application, this disclosure will enable those skilled in the art to recognize additional embodiments and/or applications which fall within the scope of the present invention. Accordingly, the scope of the present invention should be limited only to the extent of the following claims.

What is claimed is:

1. A connector in combination with a personal safety device, comprising:

a structural member having a first end and a second end;

a bolt having a shaft, a head connected to a first end of the shaft, wherein the head is larger in diameter than the shaft, and a shoulder connected to an intermediate portion of the shaft, wherein the shoulder is larger in diameter than the shaft, wherein both a flange on the personal safety device and the first end of the structural member are disposed on the shaft and captured between the head and the shoulder, and a second, opposite end of the shaft is selectively connected to the second end of the structural member.

2. The connector of claim 1, wherein an opening is provided in the second end of the structural member to selectively receive the second, opposite end of the shaft.

3. The connector of claim 2, wherein the second, opposite end of the shaft is provided with external threads, and the opening is provided with mating internal threads.

4. The connector of claim 3, further comprising a helical coil spring disposed on the shaft between the shoulder and the first end of the structural member.

5. The connector of claim 4, wherein the structural member is generally U-shaped.

6. The connector of claim 1, further comprising a helical coil spring disposed on the shaft between the shoulder and the first end of the structural member.

7. The connector of claim 1, wherein the structural member is generally U-shaped.

8. The connector of claim 1, wherein the flange on the personal safety device is secured to the shaft between the shoulder and the first end of the structural member.

9. The connector of claim 8, further comprising a helical coil spring disposed on the shaft between the shoulder and the flange.

10. The connector of claim 1, wherein another flange on the personal safety device is selectively secured to the shaft between the shoulder and the second end of the structural member.

11. A personal safety device, comprising:

a base;

a reel rotatably mounted on the base;

a line wound about the reel and having an accessible end;

a structural member having a first end and a second end;

a bolt having a shaft, a head connected to a first end of the shaft, wherein the head is larger in diameter than the shaft, and a shoulder connected to an intermediate portion of the shaft, wherein the shoulder is larger in diameter than the shaft, wherein both the first end of the structural member and a flange on the base are mounted on the shaft and captured between the head and the shoulder, and a second, opposite end of the shaft is selectively connected to the second end of the structural member.

12. The personal safety device of claim 11, wherein another flange on the base is selectively mounted on the shaft and captured between the shoulder and the second end of the structural member.

13. The personal safety device of claim 11, further comprising a helical coil spring disposed on the shaft and compressed between the shoulder and the flange.

14. The personal safety device of claim 11, wherein the structural member is generally U-shaped.

15. The personal safety device of claim 11, wherein an opening is provided in the second end of the structural member to selectively receive the second, opposite end of the shaft.

16. The personal safety device of claim 15, wherein the second, opposite end of the shaft is provided with external threads, and the opening is provided with mating internal threads.

17. The personal safety device of claim 16, further comprising a helical coil spring disposed on the shaft and compressed between the shoulder and the flange.

* * * * *